US011670214B2

(12) United States Patent
Fang et al.

(10) Patent No.: US 11,670,214 B2
(45) Date of Patent: Jun. 6, 2023

(54) CIRCUIT DRIVING SYSTEM, DRIVER CHIP, AND DISPLAY DEVICE

(71) Applicant: TCL CHINA STAR OPTOELECTRONICS TECHNOLOGY CO., LTD., Shenzhen (CN)

(72) Inventors: Xiaoli Fang, Shenzhen (CN); Guangxing Xiao, Shenzhen (CN)

(73) Assignee: TCL CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 548 days.

(21) Appl. No.: 16/758,407

(22) PCT Filed: Apr. 21, 2020

(86) PCT No.: PCT/CN2020/085794
§ 371 (c)(1),
(2) Date: Apr. 23, 2020

(87) PCT Pub. No.: WO2021/203470
PCT Pub. Date: Oct. 14, 2021

(65) Prior Publication Data

US 2022/0309987 A1 Sep. 29, 2022

(30) Foreign Application Priority Data

Apr. 9, 2020 (CN) ..... 202010273513.5

(51) Int. Cl.
*G09G 3/20* (2006.01)

(52) U.S. Cl.
CPC ... *G09G 3/2092* (2013.01); *G09G 2310/0286* (2013.01); *G09G 2310/08* (2013.01); *G09G 2330/026* (2013.01)

(58) Field of Classification Search
CPC .... G09G 3/20; G09G 3/2092; G09G 2310/08; G09G 2330/02; G09G 2330/026
See application file for complete search history.

(56) References Cited

U.S. PATENT DOCUMENTS

2007/0085801 A1* 4/2007 Park ..... G09G 3/3611 345/98
2007/0091051 A1* 4/2007 Shen ..... G09G 3/3688 345/100

(Continued)

FOREIGN PATENT DOCUMENTS

CN 1967642 A 5/2007
CN 201355799 Y 12/2009

(Continued)

*Primary Examiner* — Patrick O Neill
(74) *Attorney, Agent, or Firm* — PV IP PC; Wei Te Chung; Zhigang Ma

(57) ABSTRACT

A circuit driving system, a driver chip, and a display device are provided. The circuit driving system and the driver chip are applied to a display driving of a display panel. The circuit driving system includes a timing control unit, a driving unit and, a time-sharing switch unit. The time-sharing switch unit is configured to control a switching state of the driving unit, so that the timing control unit and the driving unit in the circuit driving system are turned on step by step.

15 Claims, 3 Drawing Sheets

(56) References Cited

U.S. PATENT DOCUMENTS

| | | | | |
|---|---|---|---|---|
| 2013/0120344 | A1 | 5/2013 | Liao et al. | |
| 2021/0020119 | A1* | 1/2021 | Wang | G09G 3/3406 |

FOREIGN PATENT DOCUMENTS

| | | | |
|---|---|---|---|
| CN | 102402957 | A | 4/2012 |
| CN | 102938240 | A | 2/2013 |
| CN | 205069083 | U | 3/2016 |
| CN | 108447454 | A | 8/2018 |
| CN | 109599049 | A | 4/2019 |
| JP | 2013254149 | A | 12/2013 |

* cited by examiner

CIRCUIT DRIVING SYSTEM, DRIVER CHIP, AND DISPLAY DEVICE

FIELD OF INVENTION

The present disclosure relates to the field of display technologies, and more particularly to a circuit driving system, a driver chip, and a display device.

BACKGROUND OF INVENTION

A circuit driving system of a display panel is configured to drive the display panel to display images. At a stage when the display panel is turned on by an external power supply and starts displaying images, power provided by the external power supply will wake up multiple functional modules of the circuit driving system at the same time. However, power provided by the external power supply usually has a constant power, and a large current will be generated during a process of waking up each functional module. As a result, a voltage applied to each functional module by the external power supply is significantly reduced. That is, there is an issue that a voltage V acting on the circuit driving system fluctuates greatly as the display panel is turned on as shown in FIG. 1. An abnormal fluctuation of the voltage will further cause initial values of some sensitive registers in the circuit driving system to be changed, resulting in abnormal output of the circuit driving system and abnormal display of the display panel. The prior art adopts a method of adding a voltage stabilizing capacitor inside or outside the circuit driving system to prevent an initial value of a register from being changed. However, this approach cannot fundamentally prevent occurrence of the above issues and will greatly increase complexity and manufacturing cost of the circuit.

Technical Problem

In the prior art, when the display panel is turned on, voltage signals received by modules inside the circuit driving system will fluctuate greatly. This voltage fluctuation will cause initial values of some registers to be changed, causing the circuit driving system to output abnormal signals.

SUMMARY OF INVENTION

In order to solve the above technical problems, solutions provided by the present application are as follows:

An embodiment of the present application provides a circuit driving system, which is applied to a display driving of a display panel, comprising a timing control unit, a driving unit, and a time-sharing switch unit. The timing control unit is configured to generate a clock signal to control working timing of the driving unit. The driving unit is configured to provide a driving signal to a display unit of the display panel to control a display function of the display panel. The time-sharing switch unit is configured to turn on or turn off the timing control unit and the driving unit in different periods under an external input or an internal program control.

In an embodiment of the present application, the driving signal provided by the driving unit is a gate driving signal acting on a gate of a switching transistor of the display unit.

In an embodiment of the present application, the driving signal provided by the driving unit is a data signal acting on a source of a switching transistor of the display unit.

In an embodiment of the present application, in a turning-on phase of the circuit driving system, the time-sharing switch unit controls the timing control unit to be turned on in preference to the driving unit.

In an embodiment of the present application, during the turning-on phase of the circuit driving system, under control of the time-sharing switch unit, a turning-on time of the timing control unit is 50 microseconds to 200 microseconds earlier than a turning-on time of the driving unit.

In an embodiment of the present application, during the turning-on phase of the circuit driving system, under the control of the time-sharing switch unit, the turning-on time of the timing control unit is 100 microseconds earlier than the turning-on time of the driving unit.

In an embodiment of the present application, the clock signal generated by the timing control unit is a square wave type signal, and the driving unit captures that a rising edge of the clock signal is an effective trigger signal.

In an embodiment of the present application, the time-sharing switch unit controls the timing control unit to be turned on or turned off by transmitting a first switching signal to the timing control unit.

In an embodiment of the present application, the time-sharing switch unit controls the driving unit to be turned on or turned off by transmitting a second switching signal to the driving unit.

In an embodiment of the present application, the driving unit comprises a shift register, a logic control unit, and an output unit; the shift register is electrically connected to the time-sharing switch unit, the time-sharing switch unit controls turning-on or turning-off of the shift register, the shift register is configured to receive and store a start signal, and transmit the start signal to the logic control unit; the logic control unit is electrically connected to the timing control unit, and the logic control unit performs logical operations on the clock signal provided by the timing control unit and the start signal transmitted by the shift register to provide an output signal to the output unit; and the output unit outputs the driving signal according to the output signal provided by the logic control unit.

An embodiment of the present application further provides a driver chip, which is applied to a display driving of a display panel, comprising a driving unit configured to provide a driving signal to a display unit of the display panel to control a display function of the display panel; and a time-sharing switch unit configured to turn on or turn off the driving unit under an external input or an internal program control.

In an embodiment of the present application, the driving unit comprises: a shift register configured to receive and store a start signal; a logic control unit electrically connected to the shift register, wherein the logic control unit receives a clock signal, and performs logical operations on the clock signal and the start signal to generate an output signal; and an output unit electrically connected to the logic control unit and configured to output the driving signal according to the output signal provided by the logic control unit.

In an embodiment of the present application, the time-sharing switch unit is electrically connected to the shift register, and the time-sharing switch unit realizes turning-on or turning-off of the driving unit by controlling a switching state of the shift register.

In an embodiment of the present application, time that the time-sharing switch unit turns on the driving unit is delayed from 50 microseconds to 200 microseconds from time when the logic control unit first receives the clock signal.

In an embodiment of the present application, the time that the time-sharing switch unit turns on the driving unit is delayed by 100 microseconds from the time when the logic control unit first receives the clock signal.

An embodiment of the present application further provides a display device, comprising a display panel; and the above circuit driving system. The circuit driving system is configured to drive the display panel to display.

In an embodiment of the present application, during the turning-on phase of the circuit driving system, under control of the time-sharing switch unit, a turning-on time of the timing control unit is 50 microseconds to 200 microseconds earlier than a turning-on time of the driving unit.

In an embodiment of the present application, the driving unit comprises a shift register, a logic control unit, and an output unit. The shift register is electrically connected to the time-sharing switch unit, the time-sharing switch unit controls turning-on or turning-off of the shift register, the shift register is configured to receive and store a start signal, and transmit the start signal to the logic control unit. The logic control unit is electrically connected to the timing control unit, and the logic control unit performs logical operations on the clock signal provided by the timing control unit and the start signal transmitted by the shift register to provide an output signal to the output unit. The output unit outputs the driving signal according to the output signal provided by the logic control unit.

An embodiment of the present application further provides a display device comprising a display panel and a driver chip configured to drive the display panel to display. The driver chip includes a driving unit configured to provide a driving signal to a display unit of the display panel to control a display function of the display panel; and a time-sharing switch unit configured to turn on or turn off the driving unit under an external input or an internal program control.

In an embodiment of the present application, the driving unit comprises: a shift register configured to receive and store a start signal; a logic control unit electrically connected to the shift register, wherein the logic control unit receives a clock signal, and performs logical operations on the clock signal and the start signal to generate an output signal; and an output unit electrically connected to the logic control unit and configured to output the driving signal according to the output signal provided by the logic control unit. The time-sharing switch unit is electrically connected to the shift register, and the time-sharing switch unit realizes turning-on or turning-off of the driving unit by controlling a switching state of the shift register.

Beneficial Effect

In an embodiment of the present application, the time-sharing switch unit is provided in the circuit driving system and the driver chip, and a switching state of the driving unit is controlled by the time-sharing switch unit, so that the timing control unit and the driving unit in the circuit driving system are turned on step by step. This avoids an abnormal output of the driving unit caused by an unstable voltage signal at an initial stage of startup of the display panel, which is beneficial to high-quality display of the display panel.

DESCRIPTION OF DRAWINGS

In order to explain the technical solution in the embodiments or the prior art more clearly, the accompanying drawings used in the description of the embodiments or the prior art will be briefly introduced below. Obviously, the drawings in the following description are only some embodiments of the present invention. For those of ordinary skill in the art, other drawings can be obtained according to the drawings without paying creative efforts.

DETAILED DESCRIPTION OF PREFERRED EMBODIMENTS

Figure 1:
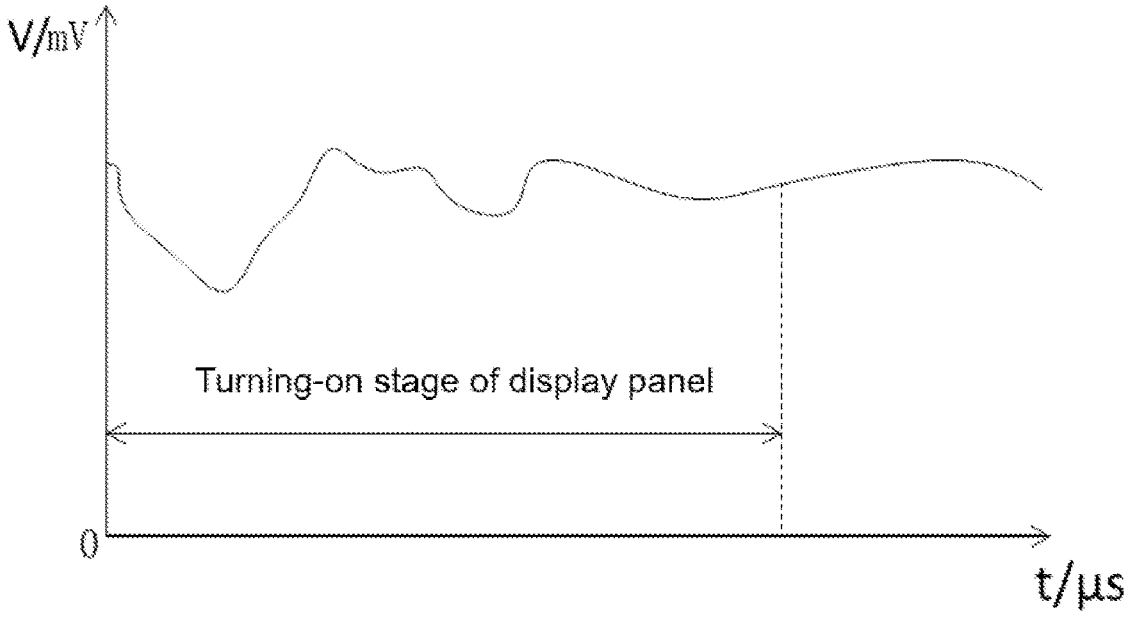
FIG. 1 is a schematic diagram showing that a voltage acting on a circuit driving system greatly fluctuates during a turning-on phase of a display panel in the prior art.

The following descriptions of the embodiments are made with reference to additional illustrations to illustrate specific embodiments in which the present invention can be implemented. The directional terms mentioned in the present invention, such as up, down, front, back, left, right, inside, outside, side, etc., are only directions referring to the accompanying drawings. Therefore, the directional terms used are for explaining and understanding the present invention, but not for limiting the present invention. In the figures, similarly structured units are denoted by the same reference numerals.

An embodiment of the present application provides circuit driving system, a time-sharing switch unit is provided in the circuit driving system, and a switching state of a driving unit is controlled by the time-sharing switch unit, so that the timing control unit and the driving unit in the circuit driving system are turned on step by step. This avoids an abnormal output of the driving unit caused by an unstable voltage signal at an initial stage of startup of a display panel, which is beneficial to high-quality display of the display panel.

Figure 2:
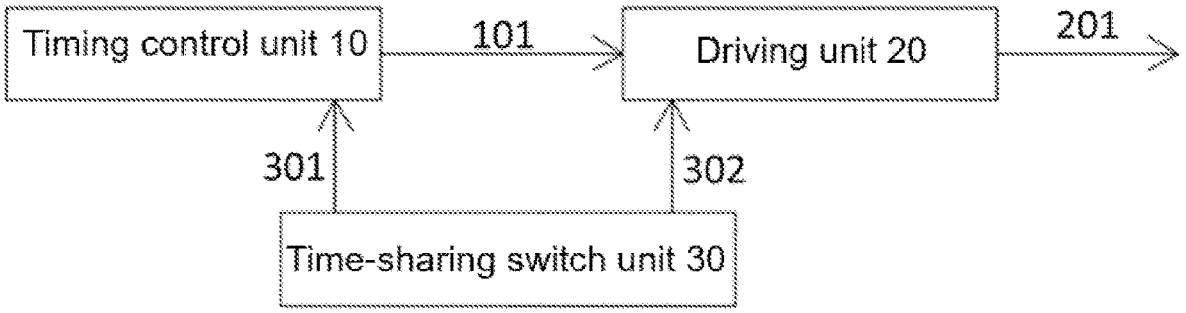
FIG. 2 is an architecture diagram of a circuit driving system according to an embodiment of the present application.

Referring to FIG. 2, which is an architecture diagram of a circuit driving system according to an embodiment of the present application. The circuit driving system includes a timing control unit 10, a driving unit 20, and a time-sharing switch unit 30. It should be noted that the circuit driving system is applied to a display driving of a display panel. A driving signal 201 output by the driving unit 20 acts on a display unit of the display panel. For example, the driving signal 201 may be a gate driving signal acting on a gate of a corresponding switching transistor of the display unit to control a turning-on state of the switching transistor. The driving signal 201 may also be a data signal acting on a source of the corresponding switching transistor of the display unit, for providing display data information for the display unit.

The timing control unit 10 is configured to generate a clock signal 101, and the clock signal 101 is configured to control an operation timing of the driving unit 20. Optionally, the clock signal 101 may be a square wave type signal. The driving unit 20 captures a rising edge of the clock signal 101 as an effective trigger signal. By performing logical calculation on the captured clock signal 101, the driving signal 201 is output.

The driving unit 20 is configured to provide the driving signal 201 to the display unit of the display panel. The driving signal 201 directly acts on the display panel or the display unit of the display panel, thereby controlling a display function of the display panel. Alternatively, the driving signal 201 may be a gate driving signal acting on a gate of a corresponding switching transistor of the display unit to control a turning-on state of the switching transistor. The driving signal 201 may also be a data signal acting on a source of the corresponding switching transistor of the display unit, for providing display data information for the display unit.

The time-sharing switch unit 30 is configured to turn on or turn off the timing control unit 10 and the driving unit 20 in different periods under an external input or an internal program control. Specifically, the time-sharing switch unit 30 is electrically connected to the timing control unit 10 and the driving unit 20. The time-sharing switch unit 30 controls the timing control unit 10 to be turned on or turned off by transmitting a first switching signal 301 to the timing control unit 10. The time-sharing switch unit 30 controls the driving unit 20 to be turned on or turned off by transmitting a second switching signal 302 to the driving unit 20. It should be understood that by setting the time-sharing switch unit 30, the timing control unit 10 and the driving unit 20 can be turned on or turned off in different periods. Therefore, during an initial stage of startup of the display panel, issue of large voltage fluctuations in the system caused by the timing control unit 10 and the driving unit 20 being turned on at the same time is avoided and issue that the driving unit 20 abnormally outputs the driving signal 201 due to the voltage fluctuation is also avoided.

Further, during the turning-on phase of the circuit driving system, the time-sharing switch unit 30 controls the timing control unit 10 to be turned on in preference to the driving unit 20. It should be noted that the turning-on stage of the circuit driving system refers to a stage where the external power supply system of the display panel starts to supply power to the circuit driving system. The so-called voltage fluctuations in the system also occur at this stage. The main reason is that functional elements in the circuit driving system consume current at the same time, and the power of the external power supply is constant, which in turn causes a voltage to drop in a short time. In addition, the driving unit 20 is turned on after the timing control unit 10 is delayed. On one hand, the large current consumption caused by the driving unit 20 and the timing control unit 10 turning on simultaneously can be avoided. On another hand, it also avoids that the driving unit 20 abnormally outputs a driving signal during the voltage fluctuation stage, which is beneficial to improve a display performance of the display panel.

Optionally, during the turning-on phase of the circuit driving system, under control of the time-sharing switch unit 30, the turning-on time of the timing control unit 10 is 50 microseconds to 200 earlier than the turning-on time of the driving unit. It should be noted that by repeatedly monitoring the voltage fluctuation state in the turning-on phase of the circuit driving system, it is concluded that the voltage fluctuation is mainly concentrated within the first 100 microseconds, especially the voltage fluctuation within the first 50 microseconds is the most severe. Therefore, influence of the voltage fluctuation on the driving signal output by the driving unit 20 can be minimized by the above setting.

Further, in the turning-on phase of the circuit driving system, under the control of the time-sharing switch unit 30, the turning-on time of the timing control unit 10 is 100 microseconds earlier than the turning-on time of the driving unit 20. It should be noted that by repeatedly monitoring the voltage fluctuation state in the turning-on phase of the circuit driving system, it is concluded that the voltage fluctuation is mainly concentrated within the first 100 microseconds, especially the voltage fluctuation within the first 50 microseconds is the most severe. Therefore, the influence of the voltage fluctuation on the driving signal output by the driving unit 20 can be avoided by the above setting.

Figure 3:
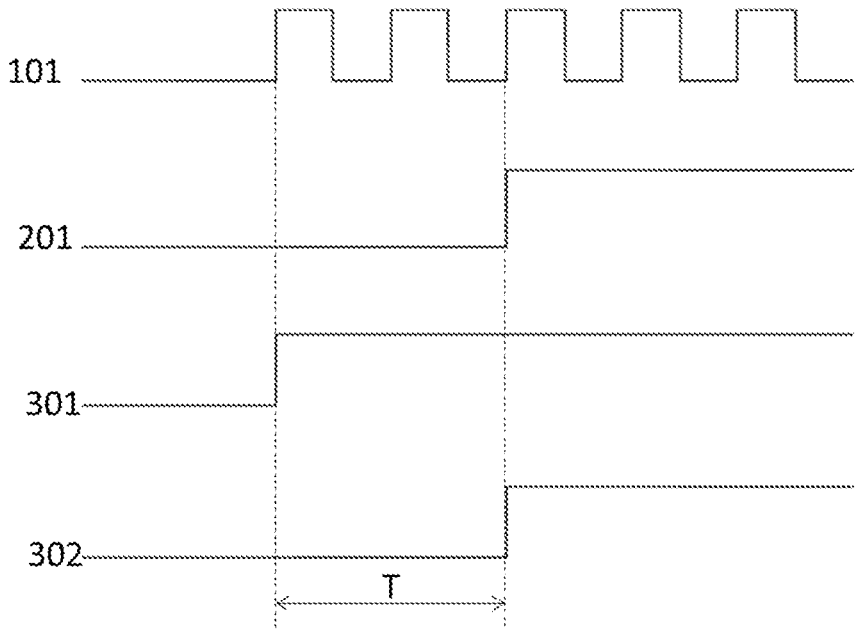
FIG. 3 is an input and output timing diagram of each unit in a turning-on phase of a circuit driving system according to an embodiment of the present application.

Specifically, referring to FIG. 2 and FIG. 3, FIG. 3 is an input and output timing diagram of each unit in a turning-on phase of the circuit driving system. During the turning-on phase of the circuit driving system, an external power source supplies power to the timing control unit 10, the driving unit 20, and the time-sharing switch unit 30, respectively. When a rising edge of a first switching signal 301 output by the time-sharing switch unit 30 to the timing control unit 10 arrives, the timing control unit 10 turns on and outputs a clock signal 101 to the driving unit 20. At this time, a second switch signaling 302 output by the time-sharing switch unit 30 to the driving unit 20 maintains a low level, and the driving unit 20 remains in a turning-off state. After a lapse of time T, a rising edge of the second switching signal 302 output from the time-sharing switch unit 30 to the driving unit 20 arrives, and the driving unit 20 turns on and outputs the driving signal 201. Thereby, the driving unit 20 is turned on later relative to the timing control unit 10 to avoid the influence of voltage fluctuation on the driving signal output by the driving unit 20. It should be noted that the time T may be set by input from an external input device, or may be set automatically by an internal program.

Figure 4:
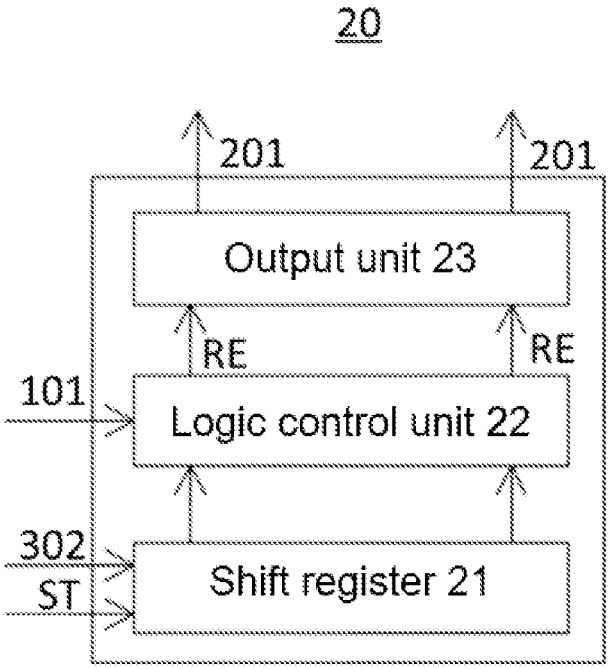
FIG. 4 is an architecture diagram of a driving unit according to an embodiment of the present application.

Optionally, as shown in FIG. 2 and FIG. 4, FIG. 4 is an architectural diagram of a driving unit according to an embodiment of the present application. The driving unit 20 includes a shift register 21, a logic control unit 22, and an output unit 23. The shift register 21 is electrically connected to the time-sharing switch unit 30. The time-sharing switch unit 30 controls the shift register 21 to be turned on or turned off, thereby achieving control of a switching state of the driving unit. The shift register 21 is configured to receive and store the start signal ST. The shift register 21 transmits the start signal ST to the logic control unit 22. It should be noted that the start signal ST is a digital analog signal input to the shift register 21. In the turning-on state of the shift register 21, the signal is input through an external input terminal or an internal program and stored in the shift register 21. This signal is finally transferred to the logic control unit 22 to participate in the logic operation, which ultimately affects the driving signal 201. During the turning-on phase of the circuit driving system, the second switching signal 302 controls the shift register 21 to remain in a turning-off state. Therefore, it is avoided that the abnormal signal generated due to the voltage fluctuation at this stage is mistakenly recognized as the start signal ST and is registered in the shift register 21.

The logic control unit 22 is electrically connected to the timing control unit 10. The logic control unit 22 performs a logical operation on the clock signal 101 provided by the timing control unit 10 and the start signal ST transmitted by the shift register 21 to provide an output signal RE to an output unit 23. The output unit 23 outputs the driving signal 201 according to the output signal RE provided by the logic control unit 22.

In summary, the circuit driving system provided in this embodiment includes a timing control unit, a driving unit, and a time-sharing switch unit. By using the time-sharing switch unit to control a switching state of the driving unit, the timing control unit and the driving unit in the circuit driving system are turned on in steps. This avoids an abnormal output of the driving unit caused by an unstable voltage signal at an initial stage of startup of the display panel, which is beneficial to a high-quality display of the display panel.

Figure 5:
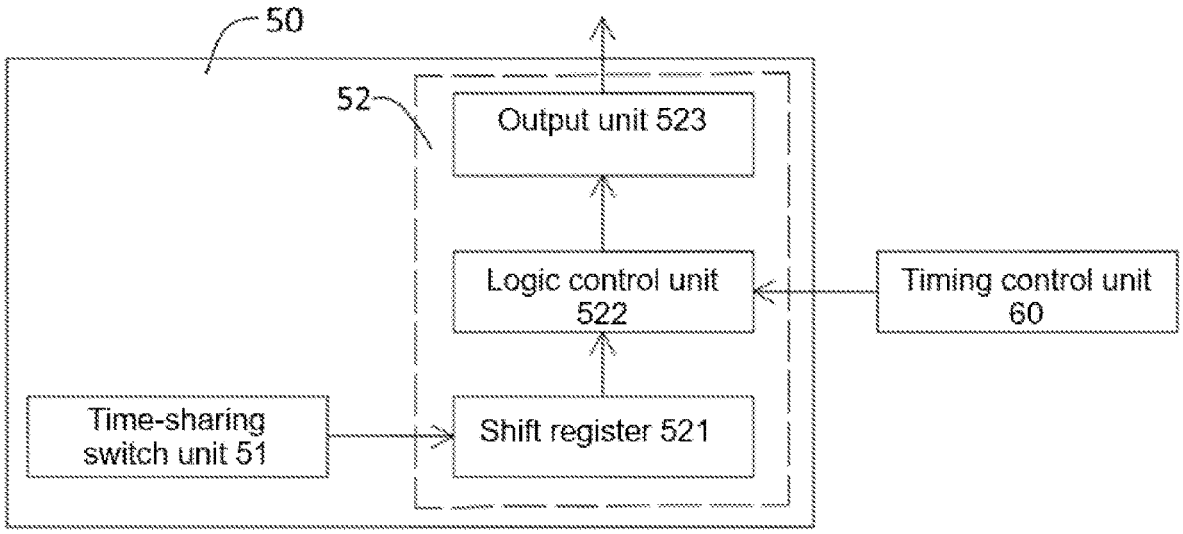
FIG. 5 is an architecture diagram of a driver chip connected to a timing control unit according to an embodiment of the present application.

An embodiment of the present application further provides a driver chip 50. As shown in FIG. 5, the driver chip 50 is applied to a display driving of a display panel. The driver chip 50 includes a time-sharing switch unit 51 and a driving unit 52. The driving unit 52 is configured to provide a driving signal to a display unit of the display panel to control a display function of the display panel. The time-sharing switch unit 51 is configured to turn on or turn off the driving unit 52 under an external input or an internal program control.

It should be noted that the driver chip 50 provided in this embodiment implements independent control of a switching state of the driving unit 52 by setting the time-sharing switch unit 51. When the driver chip 50 is applied to the display panel, the driving unit 52 is turned off by the time-sharing switch unit 51 at an initial stage of startup of the display panel. Therefore, an abnormal output of the driving unit 52 caused by the voltage fluctuation in the circuit system at this stage is avoided.

Optionally, the driving unit 52 includes a shift register 521, a logic control unit 522, and an output unit 523. The shift register 521 is configured to receive and store a start signal. The logic control unit 522 is electrically connected to the shift register 521. The logic control unit 522 receives a clock signal and performs logical operations on the clock signal and the start signal to generate an output signal. The output unit 523 is electrically connected to the logic control unit 522 and is configured to output the driving signal according to the output signal provided by the logic control unit 522. It should be noted that the start signal is a digital analog signal input to the shift register 521. In a turning-on state of the shift register 521, the signal is input through an external input terminal or an internal program and stored in the shift register 521. This signal is finally transferred to the logic control unit 522 to participate in logic operations, which ultimately affects the driving signal.

Further, the time-sharing switch unit 51 is electrically connected to the shift register 521. The time-sharing switch unit 51 realizes turning on or turning off the driving unit 52 by controlling a switching state of the shift register 521. It should be noted that when the driver chip 50 is applied to the display panel, the shift register 521 is turned off by the time-sharing switch unit 51 at the initial stage of startup of the display panel. Thereby, it is avoided that an abnormal signal generated due to the voltage fluctuation at this stage is mistakenly recognized as the start signal and is registered in the shift register 521, which in turn causes a display abnormality.

Further, the logic control unit 522 is electrically connected to an external timing control unit 60. The timing control unit 60 is configured to output a clock signal to the logic control unit 522 and participate in a logic operation of the logic control unit 522. The time that the time-sharing switch unit 51 turns on the driving unit 52 is delayed from 50 microseconds to 200 microseconds than the time when the logic control unit 522 first receives the clock signal. It should be noted that, by repeatedly monitoring the voltage fluctuation state at the initial stage of startup of the display panel, it is concluded that the voltage fluctuation is mainly concentrated within the first 100 microseconds, especially the voltage fluctuation within the first 50 microseconds is the most severe. Therefore, influence of voltage fluctuation on the driving signal output by the driving unit 52 can be minimized by the above-mentioned settings.

In summary, the driver chip provided in this embodiment includes a driving unit and a time-sharing switch unit. The time-sharing switch unit is configured to achieve independent control of a switching state of the driving unit. When the driver chip is applied to the display panel, the driving unit is turned off by the time-sharing switch unit at the initial stage of startup of the display panel. Therefore, an abnormal output of the driving unit caused by the voltage fluctuation in the circuit system at this stage is avoided, which is beneficial to a high-quality display of the display panel.

An embodiment of the present application also provides a display device. The display device includes a display panel and the circuit driving system provided by the foregoing embodiments of the present application, or the driver chip provided by the foregoing embodiments of the present application. The circuit driving system and the driver chip are configured to drive the display panel to display. The display device provided in this embodiment can use the time-sharing switch unit to achieve independent control of a switching state of the driving unit. In an initial stage of startup of the display device, the driving unit is turned off by the time-sharing switch unit. Therefore, an abnormal output of the driving unit caused by the voltage fluctuation in the circuit system at the initial stage is avoided, which is beneficial to improving a display performance of the display device.

It should be noted that although the present application is disclosed as above with specific embodiments, the above embodiments are not intended to limit the present application. Those of ordinary skill in the art can make various changes and modifications without departing from the spirit and scope of the present application. Therefore, the protection scope of the present application is subject to the scope defined by the claims.

What is claimed is:

1. A circuit driving system, comprising:

a timing control unit; a driving unit; and a time-sharing switch unit;

wherein the timing control unit is configured to generate a clock signal to control working timing of the driving unit;

wherein the driving unit is configured to provide a driving signal; and wherein the time-sharing switch unit is configured to turn on or turn off the timing control unit and the driving unit in different periods under an external input or an internal program control.

2. The circuit driving system according to claim 1, wherein in a turning-on phase of the circuit driving system, the time-sharing switch unit controls the timing control unit to be turned on in preference to the driving unit.

3. The circuit driving system according to claim 2, wherein during the turning-on phase of the circuit driving system, under control of the time-sharing switch unit, a turning-on time of the timing control unit is 50 microseconds to 200 microseconds earlier than a turning-on time of the driving unit.

4. The circuit driving system according to claim 3, wherein during the turning-on phase of the circuit driving system, under the control of the time-sharing switch unit, the turning-on time of the timing control unit is 100 microseconds earlier than the turning-on time of the driving unit.

5. The circuit driving system according to claim 1, wherein the clock signal generated by the timing control unit is a square wave type signal, and the driving unit captures that a rising edge of the clock signal is an effective trigger signal.

6. The circuit driving system according to claim 1, wherein the time-sharing switch unit controls the timing control unit to be turned on or turned off by transmitting a first switching signal to the timing control unit.

7. The circuit driving system according to claim 6, wherein the time-sharing switch unit controls the driving unit to be turned on or turned off by transmitting a second switching signal to the driving unit.

8. The circuit driving system according to claim 1, wherein the driving unit comprises a shift register, a logic control unit, and an output unit;

the shift register is electrically connected to the time-sharing switch unit, the time-sharing switch unit controls turning-on or turning-off of the shift register, the shift register is configured to receive and store a start signal, and transmit the start signal to the logic control unit;

the logic control unit is electrically connected to the timing control unit, and the logic control unit performs logical operations on the clock signal provided by the timing control unit and the start signal transmitted by the shift register to provide an output signal to the output unit; and the output unit outputs the driving signal according to the output signal provided by the logic control unit.

9. A display device, comprising:

the circuit driving system according to claim 1.

10. The display device according to claim 9, wherein during the turning-on phase of the circuit driving system, under control of the time-sharing switch unit, a turning-on time of the timing control unit is 50 microseconds to 200 microseconds earlier than a turning-on time of the driving unit.

11. The display device according to claim 9, wherein the driving unit comprises a shift register, a logic control unit, and an output unit;

the shift register is electrically connected to the time-sharing switch unit, the time-sharing switch unit controls turning-on or turning-off of the shift register, the shift register is configured to receive and store a start signal, and transmit the start signal to the logic control unit;

the logic control unit is electrically connected to the timing control unit, and the logic control unit performs logical operations on the clock signal provided by the timing control unit and the start signal transmitted by the shift register to provide an output signal to the output unit; and the output unit outputs the driving signal according to the output signal provided by the logic control unit.

12. A driver chip, comprising:

a driving unit configured to provide a driving signal; and a time-sharing switch unit configured to turn on or turn off the driving unit under an external input or an internal program control;

wherein the driving unit comprises:

a shift register configured to receive and store a start signal;

a logic control unit electrically connected to the shift register, wherein the logic control unit receives a clock signal, and performs logical operations on the clock signal and the start signal to generate an output signal; and an output unit electrically connected to the logic control unit and configured to output the driving signal according to the output signal provided by the logic control unit;

wherein the time-sharing switch unit is electrically connected to the shift register, and the time-sharing switch unit realizes turning-on or turning-off of the driving unit by controlling a switching state of the shift register.

13. The driver chip according to claim 12, wherein time that the time-sharing switch unit turns on the driving unit is delayed from 50 microseconds to 200 microseconds from time when the logic control unit first receives the clock signal.

14. The driver chip according to claim 13, wherein the time that the time-sharing switch unit turns on the driving unit is delayed by 100 microseconds from the time when the logic control unit first receives the clock signal.

15. A display device, comprising:

a driver chip;

the driver chip comprising:

a driving unit configured to provide a driving signal; and a time-sharing switch unit configured to turn on or turn off the driving unit under an external input or an internal program control;

wherein the driving unit comprises:

a shift register configured to receive and store a start signal;

a logic control unit electrically connected to the shift register, wherein the logic control unit receives a clock signal, and performs logical operations on the clock signal and the start signal to generate an output signal; and an output unit electrically connected to the logic control unit and configured to output the driving signal according to the output signal provided by the logic control unit;

wherein the time-sharing switch unit is electrically connected to the shift register, and the time-sharing switch unit realizes turning-on or turning-off of the driving unit by controlling a switching state of the shift register.

* * * * *